United States Patent [19]

Brown

[11] Patent Number: 4,765,304

[45] Date of Patent: Aug. 23, 1988

[54] INTERNAL COMBUSTION ENGINE WITH COMPRESSED AIR COLLECTION SYSTEM

[75] Inventor: Peter W. Brown, Hartland, Wis.

[73] Assignee: Outboard Marine Corporation, Waukegan, Ill.

[21] Appl. No.: 112,931

[22] Filed: Oct. 26, 1987

[51] Int. Cl.[4] ..... F02M 23/12

[52] U.S. Cl. ..... 123/532; 123/73 CB

[58] Field of Search ..... 123/73 C, 73 CB, 294, 123/303, 531, 532, 534

[56] References Cited

U.S. PATENT DOCUMENTS

| | | | |
|---|---|---|---|
| 681,111 | 8/1901 | Dickerson | 60/628 |
| 1,013,528 | 1/1912 | Broderick | 60/712 |
| 1,015,817 | 1/1912 | McLarty | 137/625.11 |
| 1,060,820 | 5/1913 | Coffin | 60/628 |
| 1,087,857 | 2/1914 | Wetzel | 60/628 |
| 1,098,047 | 5/1914 | Miles, Jr. | 60/628 |
| 1,211,231 | 1/1917 | Raabe | 123/576 |
| 1,230,536 | 6/1917 | Stoeltzlen | 123/532 |
| 1,237,312 | 8/1917 | Donning | 123/73 C |
| 1,551,731 | 9/1925 | Charter | 123/531 |
| 2,783,747 | 3/1957 | Layne | 123/532 X |
| 3,981,286 | 9/1976 | Siemens | 123/532 |
| 4,141,329 | 2/1979 | Pompei | 123/532 X |
| 4,205,638 | 6/1980 | Vlacancinch | 123/532 X |
| 4,462,760 | 7/1984 | Sarich et al. | 417/54 |
| 4,554,945 | 11/1985 | McKay | 137/312 |
| 4,628,888 | 12/1986 | Duret | 123/534 X |

*Primary Examiner*—Willis R. Wolfe

*Attorney, Agent, or Firm*—Michael, Best & Friedrich

[57] ABSTRACT

Disclosed herein is an internal combustion engine comprising a plurality of cylinders respectively including a head end, an exhaust port, and a pressure port located between the head end and the exhaust port, a like plurality of pistons respectively movable in the cylinders through respective compression strokes, a like plurality of fuel injectors respectively connected to the cylinders and operative to supply, from a fuel source to each of the cylinders, a metered quantity of fuel conveyed by compressed gas in response to fuel injector operation during the compression stroke of the associated cylinder, a storage tank for accumulating and storing compressed gas, a duct system including a selector value for selectively connecting the pressure ports to the storage tank only during the compression strokes of the associated cylinders, and a conduit connecting the storage tank to the fuel injectors for supplying the fuel injectors with compressed gas in response to fuel injector operation.

11 Claims, 1 Drawing Sheet

INTERNAL COMBUSTION ENGINE WITH COMPRESSED AIR COLLECTION SYSTEM

BACKGROUND OF THE INVENTION

The invention relates generally to internal combustion engines and, more particularly, to fuel injected internal combustion engines. Still more particularly, the invention relates to fuel injected engines in which the fuel is conveyed to the combustion chambers by a relatively low pressure gas, such as air.

Still more particularly, it has been recognized that direct cylinder fuel injection can be employed to reduce or eliminate short circuiting of air/fuel mixture out of a two-stroke exhaust port with resulting improvement in engine efficiency and a reduction in exhaust emissions.

The concept of using pressurized air as a means of atomizing relatively low pressure fuel has been employed effectively to improve the efficiency of such internal combustion engines while using a relatively low cost fuel system.

In order to utilize this concept, a supply of pressurized air is required. Such pressurized air has commonly been supplied by a mechanically or electrically driven air compressor. Such systems work efficiently but the need to provide a compressor imposes additional mechanical complexities and cost disadvantages on the otherwise relatively low cost fuel system.

Attention is directed to the following U.S. Patents:

| U.S. Pat. Nos. | | |
|---|---|---|
| 681,111 | E. N. Dickerson | August 20, 1901 |
| 1,013,528 | J. K. Broderick | January 2, 1912 |
| 1,015,817 | L. L. McLarty | January 30, 1912 |
| 1,060,820 | H. E. Coffin | May 6, 1913 |
| 1,087,857 | R. E. Wetzel | February 17, 1914 |
| 1,098,047 | D. D. Miles, Jr. | May 26, 1914 |
| 1,211,231 | H. E. A. Raabe | January 3, 1917 |
| 1,230,536 | C. L. Stoeltzlen | June 19, 1917 |
| 1,551,731 | J. A. Charter | January 29, 1923 |
| 4,462,760 | T. R. Sarich, et al. | July 31, 1984 |
| 4,554,945 | M. L. McKay | November 26, 1985 |

SUMMARY OF THE INVENTION

The invention provides an internal combustion engine comprising a plurality of cylinders respectively including a pressure port, a like plurality of pistons respectively movable in the cylinders through respective compression strokes, a like plurality of fuel injectors respectively connected to the cylinders and operative to supply, from a fuel source to the respective cylinders, a metered quantity of fuel conveyed by compressed gas in response to fuel injection operation during the compression strokes of the respective cylinders, a storage tank for accumulating and storing compressed gas, means for selectively connecting the pressure ports to the storage tank only during the compression strokes of the respective cylinders, and duct means connecting the storage tank to the fuel injectors for supplying the fuel injectors with compressed gas in response to fuel injector operation.

The invention also provides an internal combustion engine comprising a plurality of cylinders respectively including a head end, an exhaust port, and a pressure port located above the exhaust port, a like plurality of pistons respectively movable in the cylinders through respective compression strokes, a like plurality of fuel injectors respectively connected to the cylinders and operative to supply, from a fuel source to the respective cylinders, a metered quantity of fuel conveyed by compressed gas in response to fuel injector operation during the compression strokes of the respective cylinders, a storage tank for accumulating and storing compressed gas, means for selectively connecting the pressure ports to the storage tank only during the compression strokes of the respective cylinders, and duct means connecting the storage tank to the fuel injectors for supplying the fuel injectors with compressed gas in response to fuel injector operation.

In one embodiment of the invention, the internal combustion engine further includes pressure regulation means connected to the storage tank for preventing compression of the gas in the storage tank above a predetermining pressure level.

In one embodiment of the invention, the internal combustion engine also includes an air induction system communicating with at least one of the cylinders, and means communicating between the pressure regulation means and the air induction system for venting compressed gas above the predetermined pressure level to the air induction system.

In one embodiment of the invention, the means selectively connecting the pressure ports to the storage tank includes a common duct connected to the storage tank, a plurality of branch ducts respectively connected to the pressure ports, and a selector valve connected to the common and branch ducts and operable in synchronism with engine operation to permit respective communication between the pressure ports and the storage tank during the compression strokes of the associated cylinders and to otherwise prevent communication between the pressure ports and the storage tank.

In one embodiment in accordance with the invention the common duct includes valve means permitting flow to the storage tank and preventing flow from the storage tank.

In one embodiment in accordance with the invention, the engine is a two-stroke engine and the selector valve is operable to initiate communication between the pressure ports and the storage tank after closure of the exhaust ports by the pistons and is operable to terminate communication between the pressure ports and the storage tanks before closure of the pressure ports by the pistons.

In one embodiment in accordance with the invention, the selector valve is operable to terminate the communication between the pressure ports and the storage tank at about the time when the compression pressure in the cylinders is approximately the predetermined pressure level.

The invention also provides a two-stroke internal combustion engine comprising a plurality of cylinders respectively including a head end, an exhaust port, and a pressure port located above the exhaust port, an air induction system communicating with at least one of the cylinders, a like plurality of pistons respectively movable in the cylinders and through respective compression strokes, which pistons are operable to open and close the ports in response to piston movement, a like plurality of fuel injectors respectively connected to the cylinders and operative to supply, from a fuel source to each of the cylinders, a metered quantity of fuel conveyed by compressed gas in response to fuel injector operation during the compression stroke of the associated cylinder, a storage tank for accumulating and storing compressed gas, a first duct connected to the storage tank, a plurality of branch ducts respectively connected to the pressure ports, a selector valve connected to the first and branch ducts and operable in synchronism with engine operation to permit respective communication between the pressure ports and the storage tank during the compression strokes of the associated cylinders and to otherwise prevent communication between the pressure ports and the storage tank, valve means in the first duct permitting flow to the storage tank and preventing flow from the storage tank, duct means connecting the storage tank to the fuel injectors for supplying the fuel injectors with compressed gas in response to fuel injector operation, pressure regulation means connected to the storage tank for preventing compression of the gas in the storage tank above a predetermining pressure level, and means communicating between the pressure regulation means and the induction passage for venting compressed gas above the predetermined pressure level to the air induction system.

An object of the invention is to provide means for overcoming the previous need to provide an air compressor which imposed additional mechanical complexities and cost disadvantages in connection with air conveyed fuel injected engines.

IN THE DRAWINGS

Figure 1:
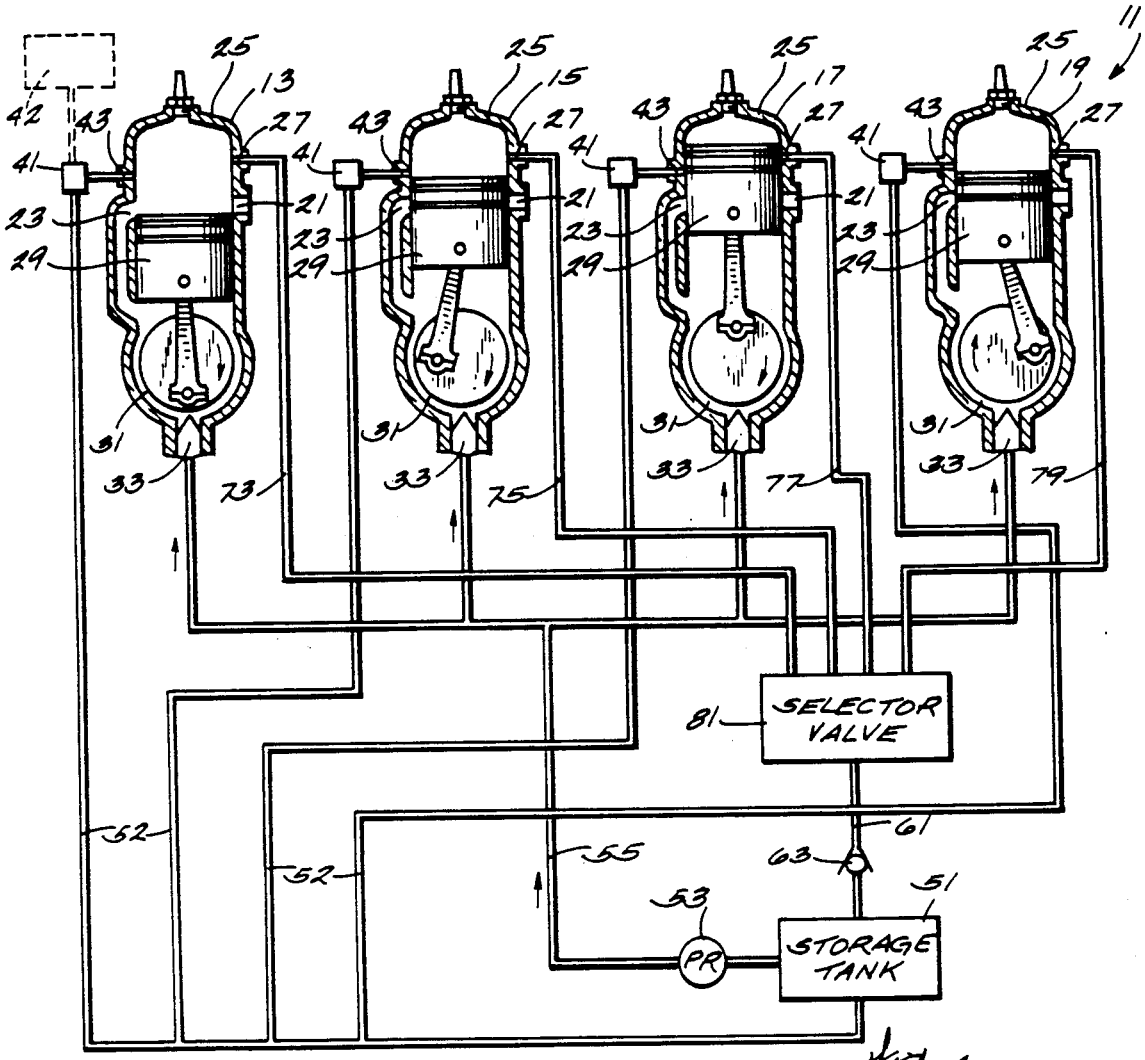
FIG. 1 is a schematic view of a internal combustion engine incorporating various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown schematically in FIG. 1 is a two stroke internal combustion engine 11 which includes a plurality of cylinders 13, 15, 17, and 19, each cylinder including an exhaust port 21, a. transfer port 23, a head end 25, and a pressure port 27 located in the cylinder between the head end 25 and the exhaust port 21. The pressure ports 27 may be positioned anywhere in the length of the cylinder above the exhaust ports 21, including in the cylinder head end 25. In some cases it is advantageous if the ports 27 are positioned just high enough in the cylinders to receive air at the maximum pressure required to afford fuel injection, as will be explained, but low enough so that they are not subjected to maximum combustion pressure.

Each cylinder also includes a piston 29 which reciprocates between a top dead center position adjacent the cylinder head end 25 and a bottom dead center position at which the exhaust port 21 and the transfer port 23 are fully open. In addition, each cylinder has associated therewith an intake or air induction system which can take various forms, and in the disclosed construction, includes a crankcase 31 which communicates with a reed valve controlled induction passage 33 through which combustion air is ingested for flow through the crankcase 31 and through the transfer passage and port 23 to the combustion chamber in accordance with normal two-stroke engine operation which includes a compression stroke during piston movement from bottom dead center to top dead center and a power stroke during piston movement from top dead center to bottom dead center.

Associated with each cylinder is a fuel injector 41. The fuel injectors 41 are all essentially of the same construction and can take any suitable form. Two examples of such constructions are disclosed in U.S. Pat. No. 4,462,760, issued July 31, 1984 and in U.S. Pat. No. 4,554,945, issued Nov. 26, 1985, which patents are incorporated herein by reference. In the disclosed construction, each fuel injector 41 communicates with a source of fuel under pressure (one such source being shown schematically as 42) and is operated by suitable electrical or mechanical means (not shown) in synchronism with engine operation to supply the associated cylinder with a metered charge of fuel which is conveyed to the cylinder by gas at a pressure above the pressure existing in the cylinder at the time of injection. The fuel can be injected through a port 43 into the cylinder at the head end 25 thereof, or at any other location deemed optimum.

The engine 11 also has associated therewith a storage tank 51 for accumulating and storing gas at a pressure sufficient to cause conveyance of the fuel from the fuel injectors 41 into the cylinders. Any suitable storage tank constructions can be employed. The storage tank 51 communicates through a series of ducts 52 with the fuel injectors 41 to supply the fuel injectors with pressurized gas which is used to convey the fuel when the fuel injectors 41 are actuated.

Associated with the storage tank 51 is a pressure regulator 53 which vents gas from the storage tank 51 in the event the pressure builds up above a predetermined level necessary to convey fuel from the fuel injectors 51 and into the cylinders. Any suitable pressure regulator construction can be employed. Preferably, the pressure regulator 53 is connected through a duct or conduit 55 which leads to at least one of the engine induction passages 33 to convey vented pressurized gas to the induction passage 33, or crankcase 31, or other part of the air induction or intake system.

Other means of regulating pressure can also be utilized, such as control of the selector valve 81, in response to a signal from a pressure switch (not shown) mounted in storage tank 51 to alternately enable and disable the selector valve in response to pressure changes in the tank 51.

Means are also provided for selectively connecting the pressure ports 27 to the storage tank 51 during at least a portion of the compression stroke in the associated cylinder to enable flow of pressurized gas, either air or fuel/air mixture, from the cylinders to the storage tank 51. While various arrangements can be employed, in the disclosed construction, such means comprises a common duct 61 connected to the storage tank 51 and preferably including a check valve 63 permitting flow to the storage tank 51 and preventing flow from the storage tank 51, together with a plurality of branch ducts 73, 75, 77, and 79 respectively connected to the pressure ports 27 of the cylinders 13, 15, 17, and 19 and a selector valve 81 which selectively communicates the branch ducts 73, 75, 77, and 79 with the common duct 61 during the compression stroke of the associated piston 29. Any suitable selector valve construction can be employed and the selector valve can be actuated either electrically or mechanically to permit the desired communication during the compression stroke and to otherwise prevent communication with the storage tank 51.

More particularly, the selector valve 81 can include a mechanical pushrod (not shown) to drive a rotor (not shown) through a ratchet or other mechanism (not shown) so as to progressively open and close the conduits 73, 75, 77 and 79 in sequence. In another embodiment, an electric solenoid or solenoids (not shown) may be used to open and close communication through the conduits 73, 75, 77, and 79, which solenoid or solenoids are controlled by a suitable timing mechanism (not shown).

Figure 2:
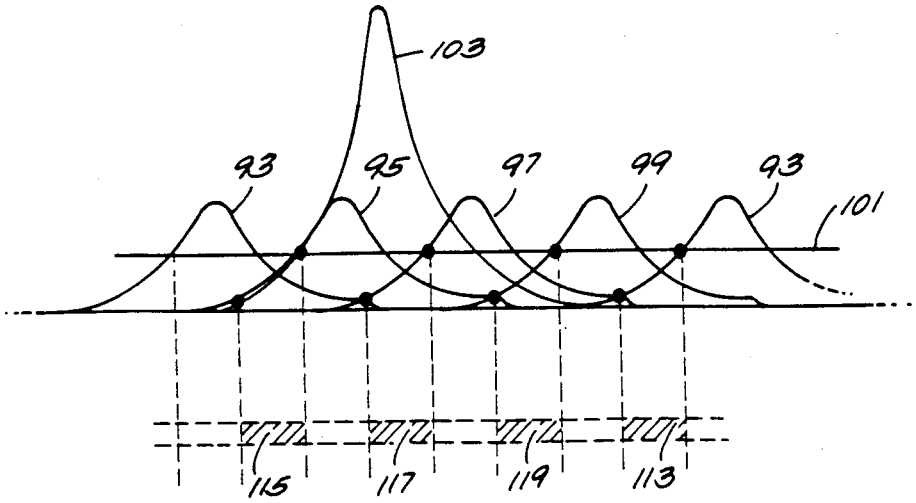
FIG. 2 is a schematic view of the operation of the engine shown in FIG. 1.

Shown in FIG. 2 is a presentation relating the pressure condition at idle in the cylinders 13, 15, 17, and 19 to the times during which the selector valve 81 communicates the cylinders 13, 15, 17, and 19 to the storage tank.

The curves 93, 95, 97, and 99 respectively represent the compression pressure in the cylinders 13, 15, 17, and 19 during idle operation. The line 101 indicates the pressure level at which the compressed gas is supplied to the fuel injectors 41. The curve 103 represents the pressure in the cylinder 15 during operation at wide open throttle. The shaded areas 113, 115, 117, and 119 represent the times (in relation to cylinder pressures) during which the pressure ports 27 respectively associated with the cylinders 13, 15, 17, and 19 are communicated with the storage tank 51.

Communication can be initiated between the pressure ports 27 and the storage tank 51 by the selector valve 81 during the compression stroke and after closure of the exhaust ports 21 at any time sufficient to convey to the storage tank 51 a quantity of gas (air or fuel/air mixture) somewhat greater in volume or amount than the volume or amount of gas employed to convey each fuel injection into the associated cylinder and at a pressure greater than the pressure in the cylinder at the time of injection. In other words, the injection is timed to occur when the pressure in the cylinder is less than the pressure in the storage tank 51.

The use of the selector valve 81 to permit communication of the cylinders with the storage tank 51 during the compression stroke and to prevent communication between the cylinders and the storage tank 51 during the expansion or power stroke advantageously serves to prevent passage to the storage tank 51 and to the fuel injectors 41 of combustion produced particulate matter which could clog flow passages and orifices in the fuel injectors 41.

While the disclosed engine 11 has been described with four cylinders, the invention is applicable to other engines with a different number of cylinders.

In addition, while the invention has been described with respect to a two-stroke engine, the invention is also applicable to a four-stroke engine.

Various of the features of the invention are set forth in the following claims.

I claim:

1. An internal combustion engine comprising a plurality of cylinders respectively including a pressure port, a like plurality of pistons respectively movable in said cylinders through respective compression strokes, a like plurality of fuel injectors respectively connected to said cylinders and operative to supply, from a fuel source to the respective cylinders, a metered quantity of fuel conveyed by compressed gas in response to fuel injector operation during the compression strokes of the respective cylinders, a storage tank for accumulating and storing compressed gas, means for selectively connecting said pressure ports to said storage tank only during the compression strokes of the respective cylinders, and duct means connecting said storage tank to said fuel injectors for supplying said fuel injectors with compressed gas in response to fuel injector operation.

2. An internal combustion engine comprising a plurality of cylinders respectively including a head end, an exhaust port, and a pressure port located above said exhaust port, a like plurality of pistons respectively movable in said cylinders through respective compression strokes, a like plurality of fuel injectors respectively connected to said cylinders at respective locations between said pressure ports and said exhaust ports and operative to supply, from a fuel source to the respective cylinders, a metered quantity of fuel conveyed by compressed gas in response to fuel injector operation during the compression strokes of the respective cylinders, a storage tank for accumulating and storing compressed gas, means for selectively connecting said pressure ports to said storage tank only during the compression strokes of the respective cylinders, and duct means connecting said storage tank to said fuel injectors for supplying said fuel injectors with compressed gas in response to fuel injector operation.

3. An internal combustion engine in accordance with claim 2 and further including pressure regulation means connected to said storage tank for preventing compression of the gas in said storage tank above a predetermined pressure level.

4. An internal combustion engine in accordance with claim 3 and further including an air induction system communicating with at least one of said cylinders, and means communicating between said pressure regulation means and said air induction system for venting compressed gas above said predetermined pressure level to said air induction system.

5. An internal combustion engine in accordance with claim 4 wherein said means selectively connecting said pressure ports to said storage tank includes a common duct connected to said storage tank, a plurality of branch ducts respectively connected to said pressure ports, and a selector valve connected to said common and branch ducts and operable in synchronism with engine operation to permit respective communication between said pressure ports and said storage tank during the compression stroke of the associated cylinder and to otherwise prevent communication between said pressure ports and said storage tank.

6. An internal combustion engine in accordance with claim 5 and further including valve means in said common duct permitting flow to said storage tank and preventing flow from said storage tank.

7. An internal combustion engine in accordance with claim 5 wherein said engine is a two-stroke engine and wherein said selector valve is operable to initiate communication between said pressure ports and said storage tank after closure of said exhaust ports by said pistons and is operable to terminate communication between said pressure ports and said storage tank before closure of said pressure ports by said pistons.

8. An internal combustion engine in accordance with claim 7 wherein said selector valve is operable to terminate communication between said pressure ports and said storage tank at about the time when the compression pressure in said cylinders is approximately said predetermined pressure level.

9. A two-stroke internal combustion engine comprising a plurality of cylinders respectively including a head end, an exhaust port, and a pressure port located above said exhaust port, an air induction system communicating with at least one of said cylinders, a like plurality of pistons respectively movable in said cylinders and through respective compression strokes, said pistons being operable to open and close said ports in response to piston movement, a like plurality of fuel injectors respectively connected to said cylinders and operative to supply, from a fuel source to each of said cylinders, a metered quantity of fuel conveyed by compressed gas in response to fuel injector operation during the compression stroke of the associated cylinder, a storage tank for accumulating and storing compressed gas, a first duct connected to said storage tank, a plurality of branch ducts respectively connected to said pressure ports, a selector valve connected to said first and branch ducts and operable in synchronism with engine operation to permit respective communication between said pressure ports and said storage tank during the compression stroke of the associated cylinders and to otherwise prevent communication between said pressure ports and said storage tank, valve means in said first duct permitting flow to said storage tank and preventing flow from said storage tank, duct means connecting said storage tank to said fuel injectors for supplying said fuel injectors with compressed gas in response to fuel injector operation, pressure regulation means connected to said storage tank for preventing compression of the gas in said storage tank above a predetermined pressure level, and means communicating between said pressure regulation means and said induction passage for venting compressed gas above said predetermined pressure level to said air induction system.

10. An internal combustion engine in accordance with claim 9 wherein said selector valve is operable to initiate communication between said pressure ports and said storage tank after closure of said exhaust ports by said pistons and is operable to terminate communication between said pressure ports and said storage tank before closure of said pressure ports by said pistons.

11. An internal combustion engine in accordance with claim 10 wherein said selector valve is operable to terminate communication between said pressure ports and said storage tank at about the time when the compression pressure at idle in said cylinders is approximately said predetermined pressure level.

* * * * *